US006079411A

United States Patent [19]

Garofalo

[11] Patent Number: 6,079,411

[45] Date of Patent: Jun. 27, 2000

[54] MOUTHPIECE WITH ORTHODONTIC TOOTH GRIP FOR DIVERS

[75] Inventor: Giovanni Garofalo, Rapallo, Italy

[73] Assignee: HTM Sport S.p.A., Italy

[21] Appl. No.: 09/188,228

[22] Filed: Nov. 9, 1998

[30] Foreign Application Priority Data

Dec. 3, 1997 [IT] Italy ..... GE97A0100

[51] Int. Cl.[7] ..... B63C 11/02

[52] U.S. Cl. ..... 128/201.27; 128/207.14; 128/201.26; 128/201.11

[58] Field of Search ..... 128/207.14, 201.11, 128/201.26, 201.27, 206.29, 201.18, 848

[56] References Cited

U.S. PATENT DOCUMENTS

| | | | |
|---|---|---|---|
| 3,207,154 | 9/1965 | Rubilotta et al. | 128/201.11 |
| 4,066,077 | 1/1978 | Shamlian . | |
| 4,162,576 | 7/1979 | Takemoto et al. . | |
| 4,520,809 | 6/1985 | de Greef et al. | 128/200.24 |
| 4,664,109 | 5/1987 | Rasocha . | |
| 5,031,611 | 7/1991 | Moles . | |
| 5,485,832 | 1/1996 | Joffity . | |
| 5,620,011 | 4/1997 | Flowers . | |

*Primary Examiner*—John G. Weiss
*Assistant Examiner*—V. Srivastava
*Attorney, Agent, or Firm*—Larson & Taylor

[57] ABSTRACT

Orthodontic tooth grip for mouthpieces of breathing pipes and/or of dispensers of self-contained breathing apparatus for scuba divers, consisting of two hollow bodies made of very thin and very elastic material and filled with a very fluid material. The said material is, for example, a liquid and/or a gel and/or a pasty material. The said tooth grip may be replaced in the event of it getting damaged.

5 Claims, 1 Drawing Sheet

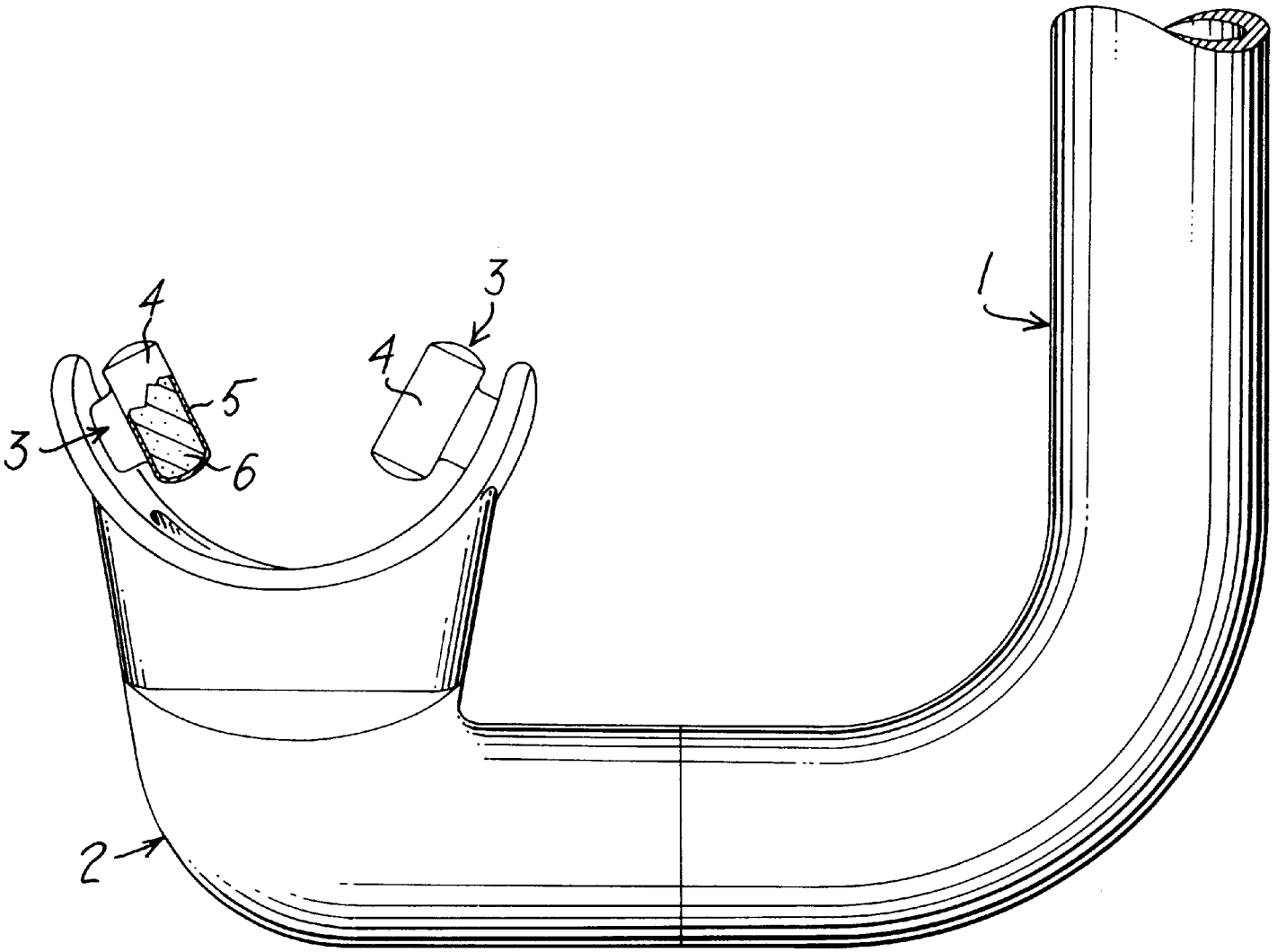
1
3
4
5
6
4
3
2

MOUTHPIECE WITH ORTHODONTIC TOOTH GRIP FOR DIVERS

BACKGROUND AND SUMMARY OF THE INVENTION

The present invention refers to a tooth grip of a mouthpiece for a breather pipe for scuba divers, or for a dispenser of a self-contained breathing apparatus.

Not infrequently, people who practise underwater sports stay in the water for a number of hours. To increase comfort during these long stays underwater, tooth grips have been made which are as anatomical as possible in order to enable a grip which is as firm as possible without at the same time this tiring the jaws.

Tooth grips are known which consist of small pipes that may be squeezed or else that are shaped by means of a thermoplastic resin, which is first immersed in boiling water and then put in the mouth of the user, who clenches his teeth so that the tooth grip takes on the shape of the dental arch, and is then taken out of the mouth and left to cool down, so as to obtain a personalized anatomical tooth grip. Such tooth grips, however, are rigid and are not able to adapt to the movements of the mouth. Consequently, they tend to "tug away" when the user turns his head.

According to the present invention, this problem is solved by creating tooth grips in the form of two hollow bodies made of very thin and very elastic material, which are filled with very fluid material, such as a liquid and/or a gel and/or a pasty material, so that when this elastic material is gripped between the teeth when the user bites on it, it takes on exactly the shape of the dental arch, adapting precisely to the shape of the user's mouth, also following the movements thereof.

BRIEF DESCRIPTION OF THE DRAWING

The present invention will be described in greater detail with reference to the single attached FIGURE, in which the invention is illustrated as applied to the mouthpiece of a breather pipe in front view, with parts shown in cross section.

DESCRIPTION OF THE PREFERRED EMBODIMENT OF THE INVENTION

The breather pipe 1, which is shown only in part, terminates with a mouthpiece 2. The tooth grip 3 is made up of two small cylinders 4 fixed to the mouthpiece. Each cylinder 4 consists of a thin, very elastic wall 5, which is filled with a fluid material 6. Possible examples of such a material are: water, an oil or a silicone gel or thermoplastic materials of very low hardness, such as thermoplastic rubbers which can be injection-moulded, as, for example, materials of the type used in mattresses for beds.

Since the tooth grip is made up in this way, it adapts to every type of dentition and, in addition, given its elasticity and softness, is able to accompany the movements of the mouth, so guaranteeing a better grip, a greater comfort and at the same time being less tiring for the jaws when it is used for a long period of time. In the manufacture of such a tooth grip, a process of co-injection may be followed; i.e., first the cylindrical outer shell with a very thin, and consequently very readily deformable, wall is moulded, and then the deformable material is injected into it.

Finally, such tooth grips, according to an embodiment not illustrated herein, may be of a type that is replaceable in the event of damage, without the need to change the whole mouthpiece, or even the whole breathing pipe.

Obviously, even though the invention has been illustrated as applied to the mouthpiece of a breather pipe, it remains understood that the same invention may equally be applied to the mouthpiece of a dispenser of a self-contained breathing apparatus.

I claim:

1. Orthodontic tooth grip for mouthpieces of self-contained breathing apparatus for scuba divers, comprising two hollow bodies made of very thin and very elastic material and filled with a very fluid material.

2. Orthodontic tooth grip as claimed in claim 1, in which said material is a liquid material.

3. Orthodontic tooth grip as claimed in claim 1, in which said material is a gel.

4. Orthodontic tooth grip as claimed in claim 1, in which said material is a pasty material.

5. Orthodontic tooth grip as claimed in claim 1, said grips being removably attached to the mouthpiece so as to be replaceable.

* * * * *